US011534765B2

(12) United States Patent
Sorensen

(10) Patent No.: US 11,534,765 B2
(45) Date of Patent: Dec. 27, 2022

(54) TEST TUBE VACUUM RETAINER

(71) Applicant: Siemens Healthcare Diagnostics Inc., Tarrytown, NY (US)

(72) Inventor: George Sorensen, Mount Bethel, PA (US)

(73) Assignee: Siemens Healthcare Diagnostics Inc., Tarrytown, NY (US)

( * ) Notice: Subject to any disclaimer, the term of this patent is extended or adjusted under 35 U.S.C. 154(b) by 193 days.

(21) Appl. No.: 16/646,047

(22) PCT Filed: Sep. 10, 2018

(86) PCT No.: PCT/US2018/050285
§ 371 (c)(1),
(2) Date: Mar. 10, 2020

(87) PCT Pub. No.: WO2019/067195
PCT Pub. Date: Apr. 4, 2019

(65) Prior Publication Data

US 2020/0276589 A1 Sep. 3, 2020

Related U.S. Application Data

(60) Provisional application No. 62/565,930, filed on Sep. 29, 2017.

(51) Int. Cl.
*B01L 9/06* (2006.01)
*B01L 3/00* (2006.01)

(52) U.S. Cl.
CPC ..... *B01L 9/06* (2013.01); *B01L 3/5082* (2013.01); *B01L 2200/023* (2013.01);
(Continued)

(58) Field of Classification Search
CPC .... B01L 9/06; B01L 3/5082; B01L 2200/023; B01L 2300/041; B01L 2300/06;
(Continued)

(56) References Cited

U.S. PATENT DOCUMENTS 3,361,343 A * 1/1968 Lerner ..... B04B 5/0421 494/20
3,568,735 A * 3/1971 Lancaster ..... B01L 3/0217 141/238

(Continued)

FOREIGN PATENT DOCUMENTS

BE 1004350 A3 11/1992
CN 204074124 U 1/2015

(Continued)

OTHER PUBLICATIONS

Extended EP Search Report dated Aug. 19, 2020 of corresponding European Application No. 18862526.3, 4 Pages.

(Continued)

*Primary Examiner* — Benjamin R Whatley
*Assistant Examiner* — Jacqueline Brazin

(57) ABSTRACT

Embodiments can provide a test tube vacuum retainer system, comprising an outer body comprising a midline plate; one or more side walls, a bottom wall, and a top plate comprising an access hole; a test tube holder comprising a sealant ring; a base; and a vacuum tube comprising an external outlet; wherein the test tube holder is secured within the outer body to the base, which in turn is secured to the midline plate; wherein the vacuum tube is connected to the test tube holder at a first end, and the external outlet is configured to be connected to a vacuum pump configured to apply a vacuum force to the test tube holder when a test tube is inserted into the access hole and placed onto the test tube holder.

19 Claims, 9 Drawing Sheets

(52) U.S. Cl.
CPC ..... *B01L 2300/041* (2013.01); *B01L 2300/06* (2013.01); *B01L 2300/0609* (2013.01); *B01L 2300/0832* (2013.01); *B01L 2300/123* (2013.01)

(58) Field of Classification Search
CPC ..... B01L 2300/0609; B01L 2300/0832; B01L 2300/123; B01L 2400/049; B25B 11/007
USPC ..... 422/562
See application file for complete search history.

(56) References Cited

U.S. PATENT DOCUMENTS 4,124,122 A * 11/1978 Emmitt ..... B01L 9/06 211/74
4,787,988 A * 11/1988 Bertoncini ..... B01D 29/05 210/808
4,803,050 A 2/1989 Mack
5,173,016 A 12/1992 Ellison et al.
5,993,745 A * 11/1999 Laska ..... B01L 9/06 211/74
6,274,091 B1 * 8/2001 Mohan ..... B01J 19/0046 422/131
6,449,827 B1 9/2002 Clarke et al.
2005/0089444 A1 * 4/2005 Justin ..... G01N 35/00029 422/403
2016/0157606 A1 6/2016 Kaelin

FOREIGN PATENT DOCUMENTS

| | | | |
|---|---|---|---|
| CN | 204564195 | U | 8/2015 |
| CN | 206103988 | U | 4/2017 |
| CN | 106732867 | A | 5/2017 |
| EP | 0904841 | A2 | 3/1999 |
| EP | 0989907 | B1 | 1/2002 |
| EP | 2799884 | A1 | 11/2014 |
| FR | 2882943 | B1 | 10/2009 |
| GB | 2422795 | A | 8/2006 |
| JP | H11-511381 | A | 10/1999 |
| JP | 2006-21208 | A | 1/2006 |
| PL | 67334 | Y1 | 8/2014 |

OTHER PUBLICATIONS

PCT International Search Report and Written Opinion dated Jan. 4, 2019 (11 Pages).

* cited by examiner

TEST TUBE VACUUM RETAINER

This application claims priority to U.S. provisional application Ser. No. 62/565,930 filed on Sep. 29, 2017, the contents of which is incorporated herein by reference in its entirety.

FIELD

Technology Field

The present invention relates generally to a system and method of retaining a test tube in a holder through the use of a partial vacuum.

Background

Plastic test tubes must be designed with a draft (a slightly conical shape) so that they can be removed from the mold. Retaining springs apply side pressure to keep them in position on a test tube carrier. Because the springs are pressing on a cone, some force is always exerted upward. If the carrier vibrates for any reason, the test tube will tend to move upward, potentially even being ejected from the carrier and damaging the test tube or losing the sample contained within. Prior art relies upon (a) eliminating sources of vibration, (b) the slight "stickiness" of a spring on the test tube surface, and (c) the slight downward pull of gravity to keep tubes in place. However, these methods are not always effective.

SUMMARY

Embodiments can provide a test tube vacuum retainer system, comprising an outer body comprising a midline plate; one or more side walls, a bottom wall, and a top plate comprising an access hole; a test tube holder comprising a sealant ring; a base; and a vacuum tube comprising an external outlet; wherein the test tube holder is secured within the outer body to the base, which in turn is secured to the midline plate; wherein the vacuum tube is connected to the test tube holder at a first end, and the external outlet is configured to be connected to a vacuum pump configured to apply a vacuum force to the test tube holder when a test tube is inserted into the access hole and placed onto the test tube holder.

Embodiments can further provide a test tube vacuum retainer system wherein the access hole has a larger diameter than the test tube holder sealant ring.

Embodiments can further provide a test tube vacuum retainer system wherein the sealant ring comprises an o-ring.

Embodiments can further provide a test tube vacuum retainer system wherein the sealant ring comprises a spherical seal.

Embodiments can further provide a test tube vacuum retainer system wherein the sealant ring comprises a conical seal.

Embodiments can further provide a test tube vacuum retainer system further comprising a retainer plate comprising an access area and a circular area; wherein the retainer plate is configured to further secure the test tube holder by placing the test tube holder within the circular area and the vacuum tube within the access area; wherein the retainer plate attaches to the outer body at a location above the base and below the top plate.

Embodiments can further provide a test tube vacuum retainer system wherein the vacuum pump is housed internally within the outer body.

Embodiments can further provide a test tube vacuum retainer system wherein the vacuum pump is housed externally outside the outer body.

Embodiments can further provide a multi-test tube vacuum retainer system, comprising an outer body comprising a midline plate; one or more side walls, a bottom wall, and a top plate comprising a first access hole, a second access hole, a first vacuum outlet, and a second vacuum outlet; a first receptacle located under the first access hole and a second receptacle located under the second access hole, each of the first receptacle and the second receptacle comprising a test tube sealant ring and a vacuum chamber; a first vacuum tube connecting the first vacuum outlet to the first receptacle; a second vacuum tube connecting the second vacuum outlet to the second receptacle; and a vacuum robot arm connected to a vacuum pump; wherein the vacuum pump is configured to apply a vacuum force to the first receptacle through the first vacuum outlet or the second receptacle through the second vacuum outlet when a vacuum is applied by the vacuum robot arm.

Embodiments can further provide a multi-test tube vacuum retainer system wherein the first vacuum outlet and the second vacuum outlet are positioned on an arc.

Embodiments can further provide a multi-test tube vacuum retainer system wherein the top plate further comprises a flexible material with one or more support fins configured to horizontally constrain a test tube when inserted into the first receptacle or the second receptacle.

Embodiments can further provide a multi-test tube vacuum retainer system further comprising one or more springs held by a center post, each configured to press a test tube against the support fins.

Embodiments can further provide a multi-test tube vacuum retainer system wherein the access holes have a larger diameter than the receptacle sealant rings.

Embodiments can further provide a multi-test tube vacuum retainer system wherein the sealant rings comprise o-rings.

Embodiments can further provide a multi-test tube vacuum retainer system wherein the sealant rings comprise spherical seals.

Embodiments can further provide a multi-test tube vacuum retainer system wherein the sealant rings comprise conical seals.

Embodiments can further provide a test tube vacuum retainer system, comprising a receptacle attached to a hollow stem; the hollow stem connected to a tank via a spring; wherein a vacuum is applied to the tank via a vacuum hose connected to a vacuum pump; wherein the hollow stem comprises a slot; wherein when a test tube is inserted into the receptacle and a downward force is applied, the slot, through depression of the spring, lowers into the tank and the vacuum is transferred within the hollow stem to secure the test tube to the receptacle.

Embodiments can further provide a test tube vacuum retainer system further comprising a power source configured to supply power to the vacuum pump.

Embodiments can further provide a test tube vacuum retainer system wherein the receptacle further comprises an o-ring.

Embodiments can further provide a test tube vacuum retainer system wherein the receptacle further comprises a spherical seal.

Embodiments can further provide a test tube vacuum retainer system wherein the receptacle further comprises a conical seal.

Additional features and advantages of the invention will be made apparent from the following detailed description of illustrative embodiments that proceeds with reference to the accompanying drawings.

BRIEF DESCRIPTION OF THE DRAWINGS

The foregoing and other aspects of the present invention are best understood from the following detailed description when read in connection with the accompanying drawings. For the purpose of illustrating the invention, there is shown in the drawings embodiments that are presently preferred, it being understood, however, that the invention is not limited to the specific instrumentalities disclosed. Included in the drawings are the following Figures.

DETAILED DESCRIPTION OF ILLUSTRATIVE EMBODIMENTS

Figure 1:
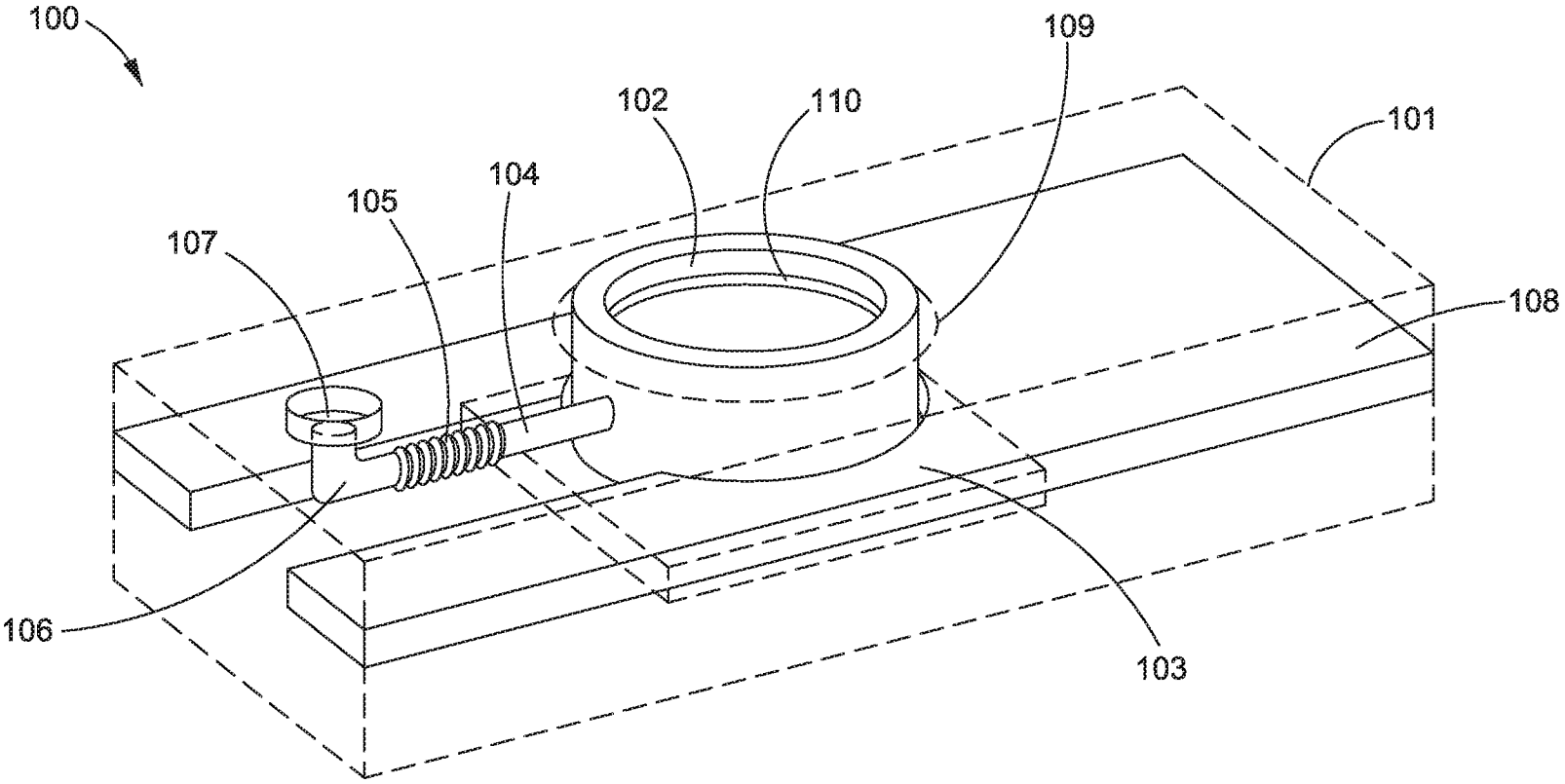
FIG. 1 illustrates a test tube vacuum retainer system, in accordance with embodiments described herein.

The following disclosure describes the present invention according to several embodiments directed at systems and methods for retaining a test tube in a holder through the use of a vacuum or partial vacuum. In a basic sense, the bottom of the test tube can be placed onto a gasket or holder with a hole, where a vacuum is drawn, creating a vacuum seal. A partial vacuum can be created that actively holds the test tube to the carrier. In this way, there need not be any reliance on passive friction or gravity to retain the tube vertically, leading to less slippage and breakage of test tubes or loss of their contents. In an embodiment, the vacuum chamber can move horizontally in order to support a variety of tube diameters.

Advantages of the present invention include active instead of passive retention of the test tube, which can greatly reduce the risk due to vibrations that may cause loss of test tube contents or vertical displacement. Reduction of sensitivity to vibrations relaxes the need to eliminate vibration during test tube transit. Additionally, a circular vacuum seal conforms to a variety of round bottom test tube diameters, allowing for a versatility of use. Alternatively, flat bottomed test tubes can also be secured to the vacuum chamber, which have typically only relied on prior art retention methods for securing. The present invention can retain tubes even when the vacuum retainer system is upside down or in a micro-gravity environment. Possible applications can include facilitating the drying of open tubes, moving tubes to different levels in an instrument using a single track (which can eliminate the added complexity of picking a tube from one track/carrier and placing it onto another track/carrier), increasing freedom of motion for sealed tubes, and systems in micro-gravity or null-gravity environments.

A partial vacuum can actively retain the test tube vertically without reliance solely on spring friction or gravity. This can relax the need to eliminate vibration during transit, increase reliability through a reduced risk of sample loss via ejection, increase reliability through a reduced risk of processing delays due to vertically displaced test tubes, reduce cost through larger track connection tolerances, reduce cost through less stringent track assembly procedures, all of which can ultimately lead to a unique and improved reliability solution.

Alternative embodiments can include springs that can press on the lip (top) of the test tube, which could serve as active retainers; or alternatively to pressing on the top, spring surface treatment or covers which could increase friction between the spring and tube. During tube pick/place operations, this additional friction may require that either spring pressure be reduced or additional force be applied to pick or place the tube. Additional alternative embodiments can include attenuating vibration due to track misalignment through slower carrier motion. Additionally, vibration due to track misalignment can be corrected through close manufacturing tolerances and careful assembly.

FIG. 1 illustrates a test tube vacuum retainer system, in accordance with embodiments described herein. The test tube vacuum retainer system 100 can have an outer body 101, which can be a rectangular prism or other shape, with at least one access hole 109 on the top side of the outer body 101. The interior of the test tube vacuum retainer system 100 can contain the vacuum system. The vacuum system can comprise a test tube holder 102, which can be a circular opening into which a test tube can fit. The test tube holder 102 can have a sealant ring 110, which can have substantially the same diameter of the inside of the test tube holder 102. The test tube holder 102 can sit atop a base 103. The test tube holder 102 can have a vacuum tube 104 attached, which can be where the vacuum suction is drawn from. The vacuum tube 104 can have a flexible portion 105, which can be used in order for the vacuum tube 104 to retain stability and not shear off in the event the test tube holder shifts, as may be the case if a test tube with a larger or smaller diameter than normal is used with the test tube vacuum retainer system 100. The vacuum tube 104 can have a bent section 106 in order for the vacuum tube 104 to have an external outlet 107 for connection with a vacuum pump. In an embodiment, the external outlet 107 can be flush against or slightly raised against the top portion of the outer body 109.

In an embodiment, the access hole 109 can have a larger diameter than the test tube holder 102, in order for the test tube vacuum retainer system 100 to be used with test tubes of varying diameters. In an embodiment, the access hole 109 can be circular or any other shape needed to accommodate the desired range of horizontal motion of the test tube holder 102. In accommodating test tubes of different sizes, the test tube holder 102 and base 103 can move within the body of the test tube vacuum retainer system 100. One or more springs can be used to restrict movement of the test tube and/or the test tube holder, and return the components to their original position after use. As the test tube holder 102 and base 103 move, the flexible portion 105 of the vacuum tube 104 can contract or expand as needed to ensure the vacuum tube 104 maintains a secure connection with the test tube holder 102. To provide additional stability to the test tube holder 102, a retainer plate 108 can be secured around the middle area of the body 101 of the test tube vacuum retainer system. The retainer plate 108 can prevent vertical displacement of the test tube holder 102 and base 103.

Figure 2:
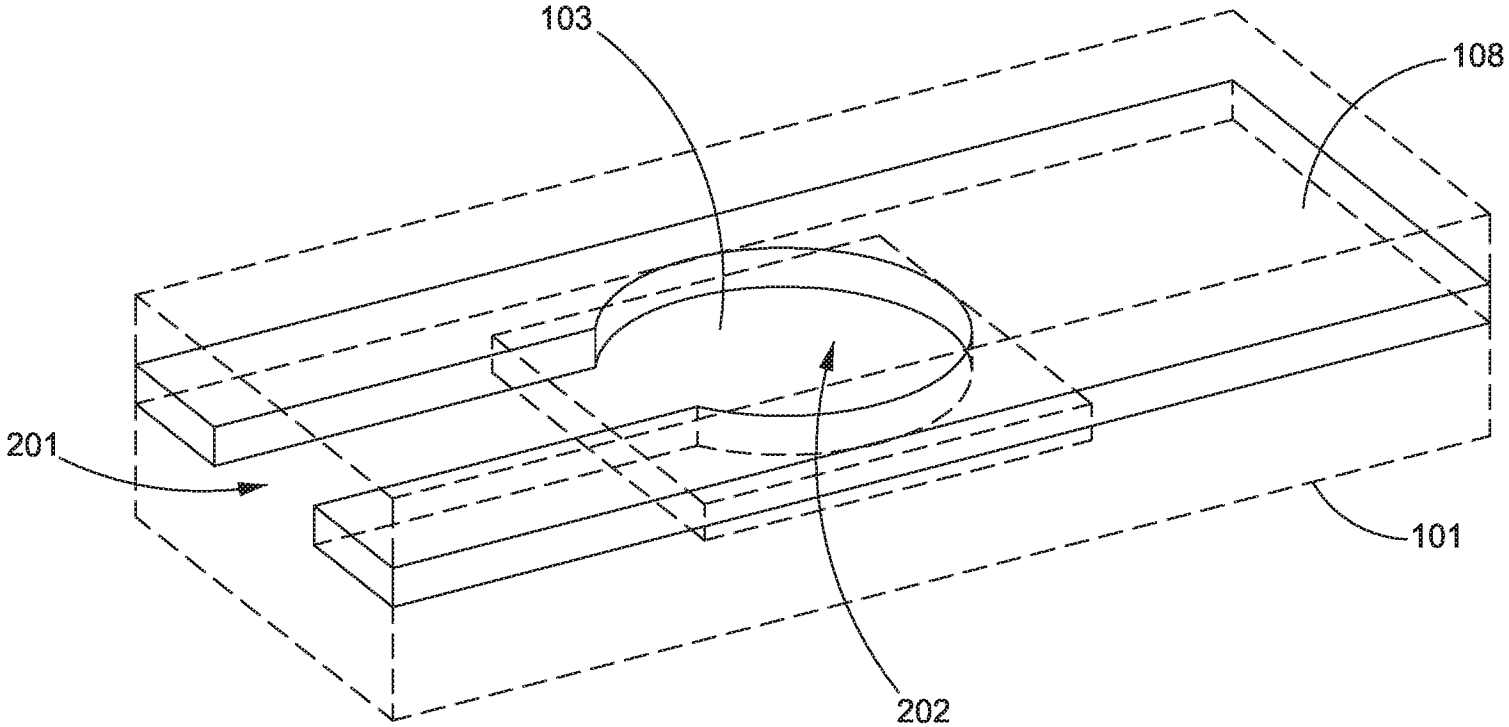
FIG. 2 illustrates a perspective view of the test tube vacuum retainer system, in accordance with embodiments described herein.
Figure 3:
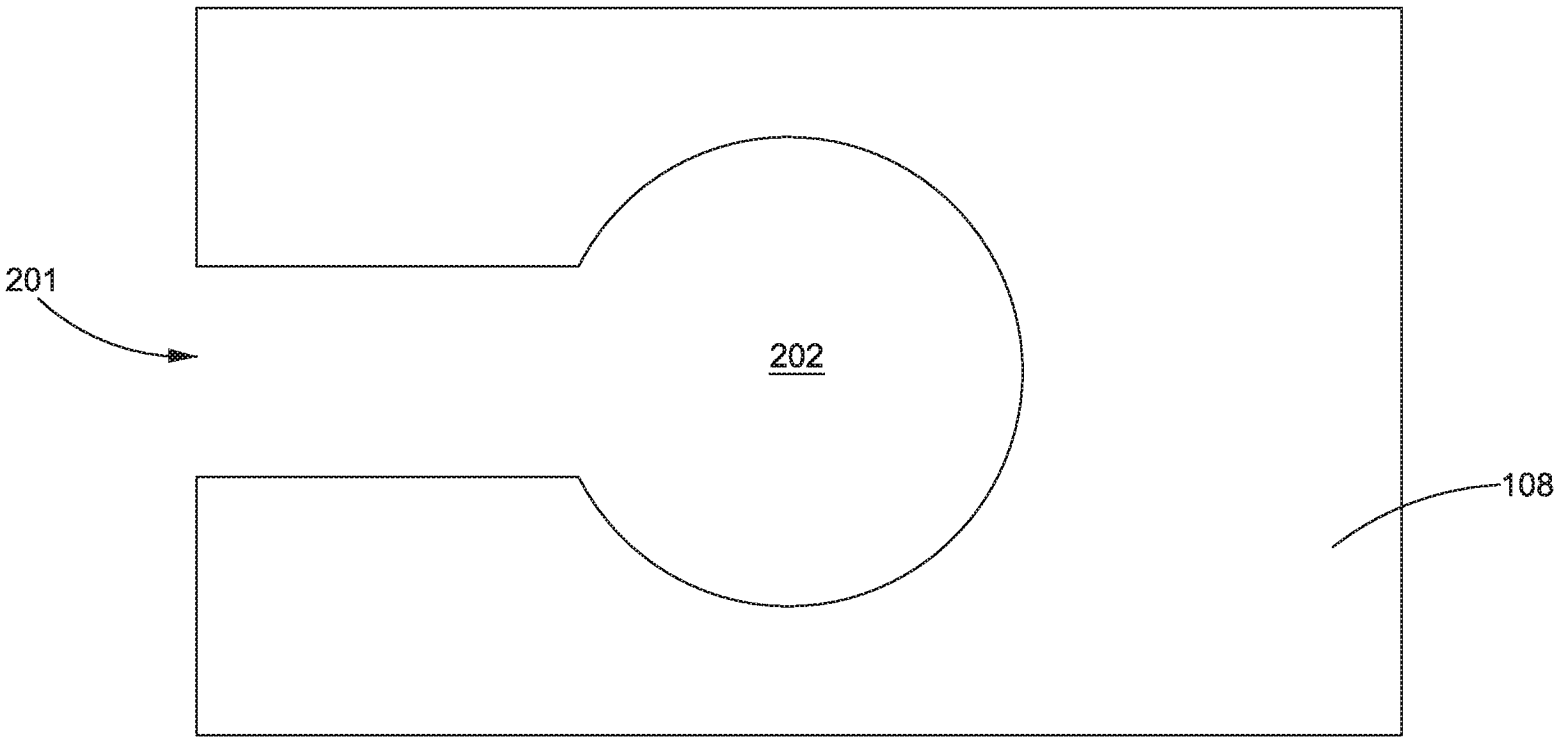
FIG. 3 illustrates a top view of the retainer plate in isolation, in accordance with embodiments described herein.

FIG. 2 illustrates a perspective view of the test tube vacuum retainer system, in accordance with embodiments described herein, while FIG. 3 illustrates a top view of the retainer plate in isolation. In this view, the test tube holder and vacuum tube are not shown to better illustrate the shape and position of the retainer plate 108 and base 103 (not shown in FIG. 3) in relation to the overall body 101 of the test tube vacuum retainer system. In an embodiment, the retainer plate 108 can have an access area 201, which provides space for vacuum tube 104, flexible portion 105, and bent section 106. Additionally, the retainer plate 108 can have a circular area 202, which can be used to admit the test tube holder. In an embodiment, the circular area 202 can have a larger diameter than the test tube holder and an equal or larger diameter than the access hole 109, in order to facilitate movement of the test tube holder when using test tubes of varying diameters. The retainer plate 108 can be placed above the base 103, and can be located around the middle of the body 101 of the test tube vacuum retainer system.

Figure 4:
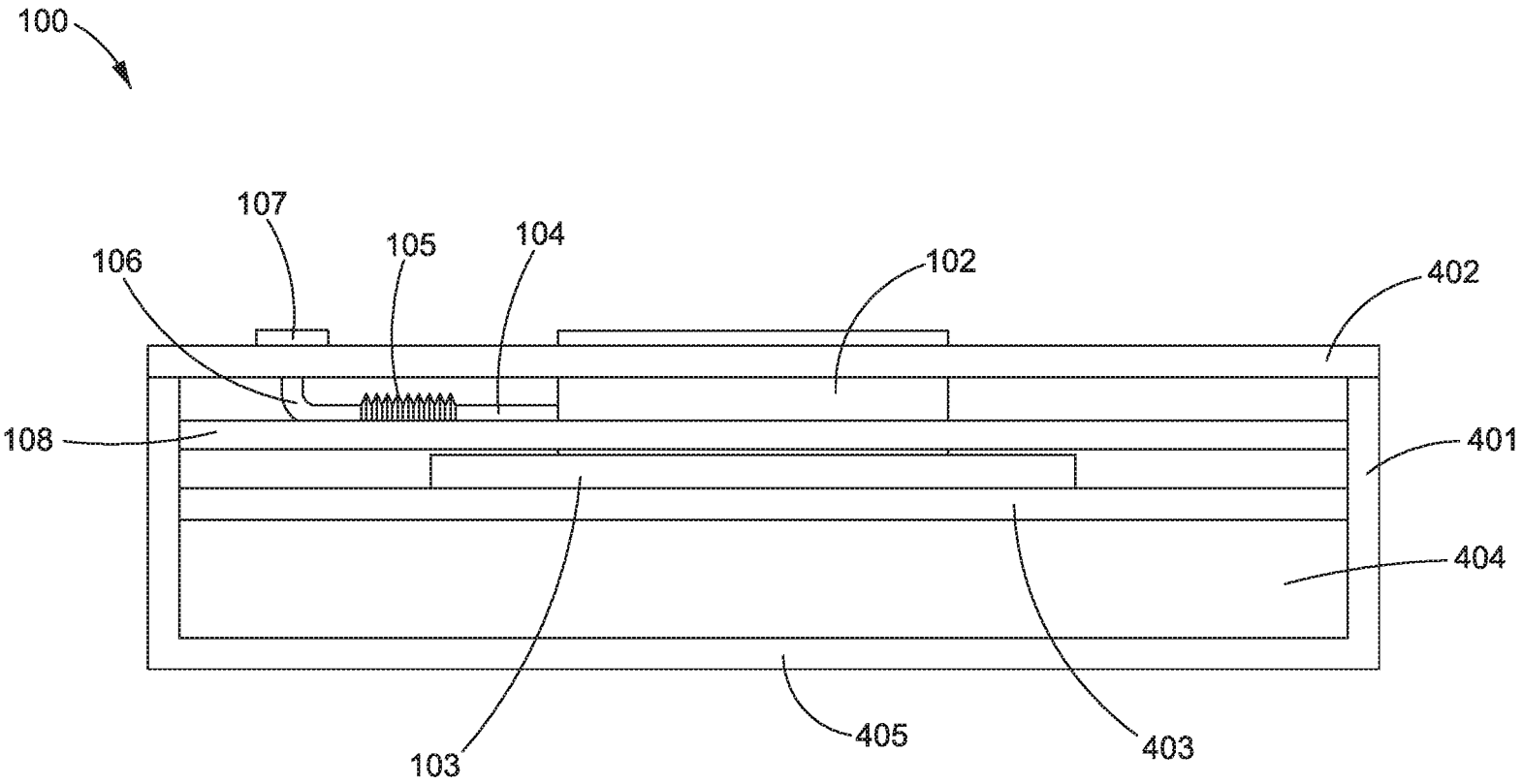
FIG. 4 illustrates a cut-away view of the test tube vacuum retainer system, in accordance with embodiments described herein.

FIG. 4 illustrates a cut-away view of the test tube vacuum retainer system, in accordance with embodiments described herein. In this view, a side wall of the outer body of the test tube vacuum retainer system has been removed. As shown, the outer body of the test tube vacuum retainer system can have a top plate 402, which can be removed as needed to access the inner mechanisms of the test tube vacuum retainer system. The test tube vacuum retainer system can have one or more side walls 401, which can bound the sides of the test tube vacuum retainer system, and a bottom wall 405. The test tube vacuum retainer system can have a midline support plate 403 which can allow for the vertical placement of the test tube holder 102, base 103, and vacuum tube 104 apparatus. From this view, the position of the retaining plate 108 can be shown to be above the base 103, which in turn can be mounted above the midline support plate 403. From this view, the retaining plate 108 can partially occlude the view of the vacuum mechanism, including the test tube holder 102 and vacuum tube 104 apparatus.

As shown, the vacuum tube 104 can extend outwards from the test tube holder 102, run laterally inside the body of the test tube vacuum retainer system, curve upward at the bent section 106, which can lead the vacuum tube 104 outside of the top plate 402, where the external outlet 107 can be placed. In an embodiment, an open space 404 can be left in the bottom half of the test tube vacuum retainer system and can be bounded by the midline support plate 403. In an embodiment, the vacuum source can be an external pump or an internal pump housed within the test tube vacuum retainer system. In an embodiment, the open space 404 can contain other components unique to a particular test tube system, such as a permanent magnet. Alternatively, the open space 404 can contain an internal power supply and/or an internal vacuum pump, in which case the bent section 106 would point down toward midline support plate 403 to interface with the internal vacuum pump.

Figure 5C:
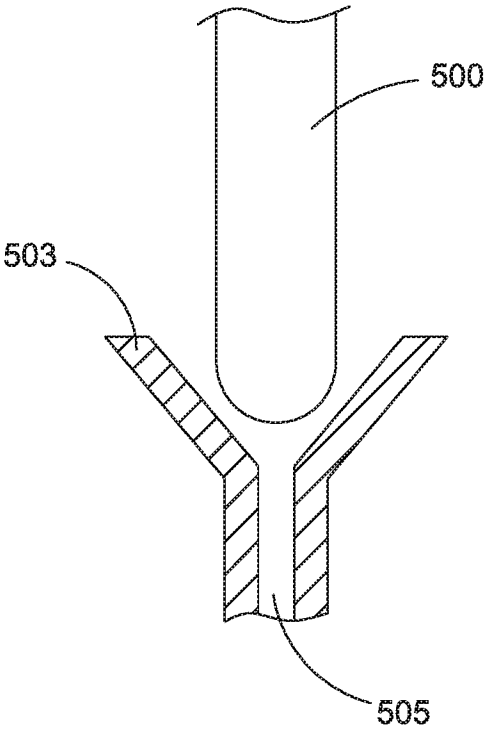
FIGS. 5A-5C depict embodiments of a sealing mechanism for the test tube vacuum retainer system, in accordance with embodiments described herein.
Figure 5B:
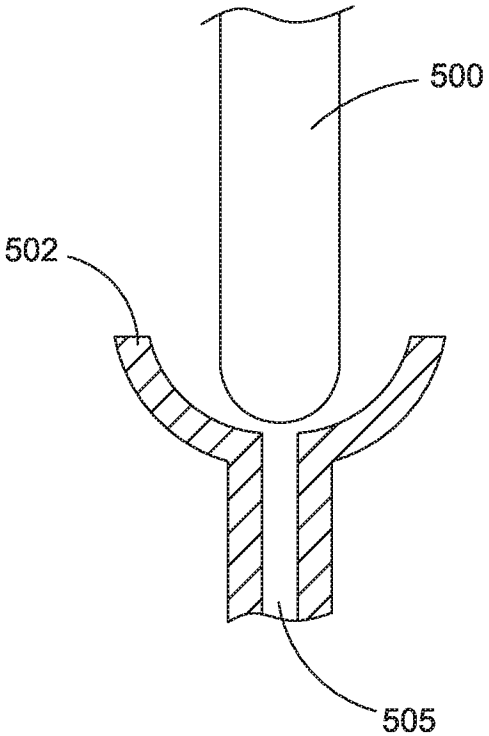
Figure 5A:
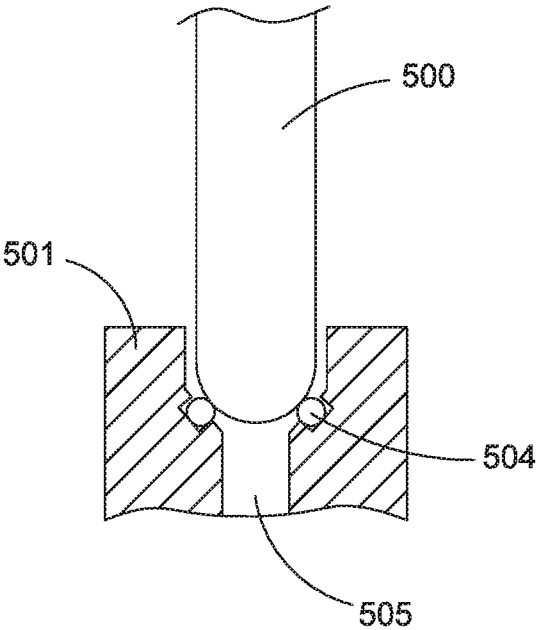

FIGS. 5A-5C depict embodiments of sealing mechanisms for the test tube vacuum retainer system. FIG. 5A depicts an embodiment showing an o-ring type seal 501, which comprises an o-ring 504. FIG. 5B depicts a spherical seal 502. FIG. 5C depicts a conical seal 503. Each of the sealant embodiments can contain an access port 505 to allow for the draw of a vacuum on the underside of the test tube 500. All of the sealant materials can be resilient materials such that a vacuum tight seal can be made between its surface and the surface of the test tube 500 when a vacuum force is applied. A common characteristic for all embodiments is a circular seal that supports multiple test tube diameters and types.

Figure 6B:
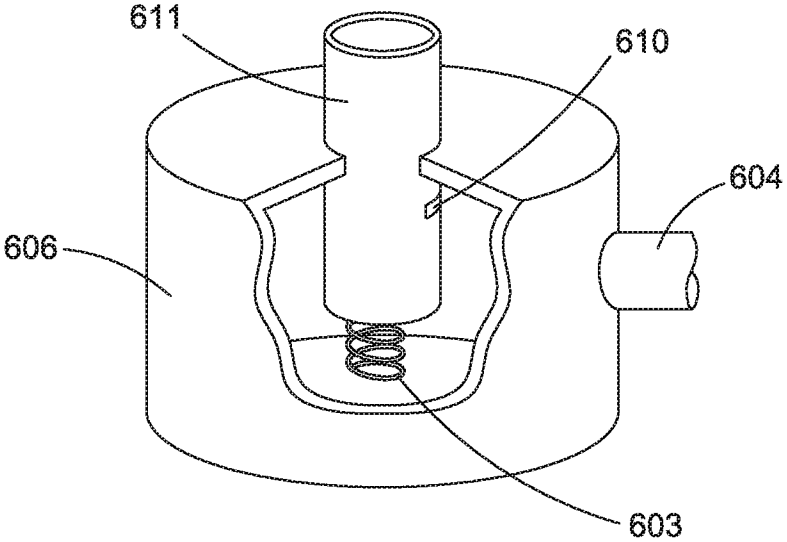
FIGS. 6A-6B depict perspective views of a test tube vacuum retainer system, in accordance with an alternate embodiment.
Figure 6A:
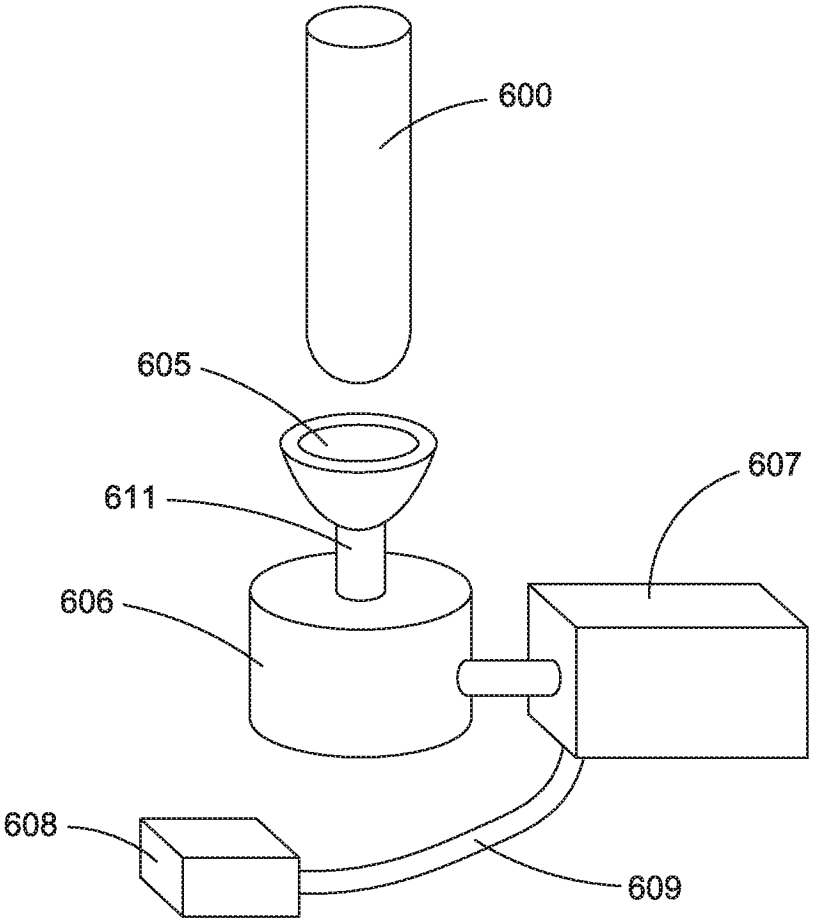

FIGS. 6A-6B depict perspective views of a test tube vacuum retainer system, in accordance with an alternate embodiment. In an alternate embodiment, a test tube 600 can be secured to the test tube vacuum retainer system through the use of a receptacle 605, which can have a spherical, o-ring, or conical seal inside. The receptacle 605 can be flexible in order to adjust direction in either the x or y plane to accommodate different test tube 600 diameters. The receptacle 605 can be attached atop a hollow stem 611, which can extend into a tank 606, where the vacuum can be drawn. The stem 611 can be attached to the tank 606 via a spring 603, which can be used to provide tension and resistance in order to keep the stem 611 and receptacle 605 in a certain position when force is not applied. A slot 610 can be cut into the stem 611 at a location that, when at rest, lies outside of the interior of the tank 606 such that when the stem 611 and receptacle 605 is at rest, ambient pressure is present and no vacuum is applied. When downwards pressure is applied to the receptacle (for instance, when a test tube 600 is inserted into the receptacle), the downwards pressure can act against the spring 603, lowering the receptacle 605 and stem 611 to a point where the slot 610 now inside the interior of the tank 606, where a vacuum can be applied via a hose 604 connected to a vacuum pump 607, which in turn can be connected to a power source 608, which can be a battery or A/C power supply.

The vacuum force can hold the receptacle 605 and stem 611 in the depressed position. After the test tube 600 is placed (i.e., inserted), the friction of the vacuum seal plus the spring force can keep the receptacle 605 in a closed position. When the test tube 600 is picked (i.e., removed), the initial pull will lift both the test tube 600 and stem 611 to expose slit 610 to ambient air. Upon exposure to ambient air, the vacuum will be lost and test tube 600 will be released from receptacle 605. In an embodiment, the receptacle 605, stem 611, and tank 606 can be accessible for cleaning.

Figure 7B:
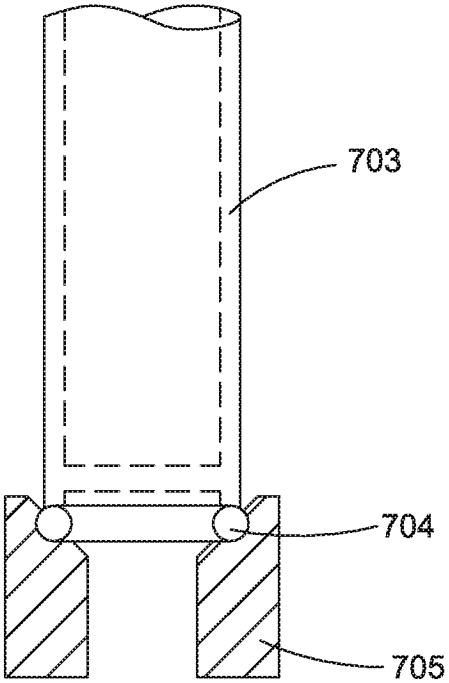
FIGS. 7A-7B illustrate various embodiments of test tubes to be used with the test tube vacuum retainer system, in accordance with embodiments described herein.
Figure 7A:
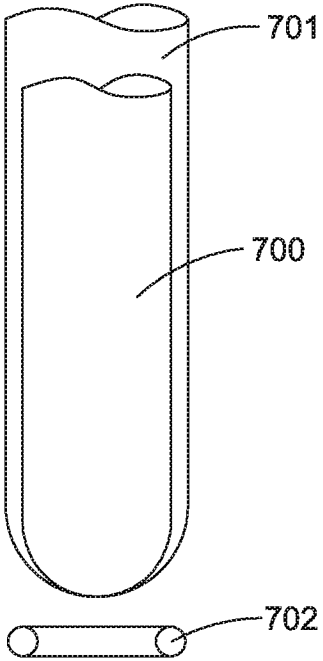

FIGS. 7A-7B illustrate various embodiments of test tubes to be used with the test tube vacuum retainer system, in accordance with embodiments described herein. As shown in FIG. 7A, a test tube of small diameter 700 can be used, along with a test tube of large diameter 701, through the use of an o-ring 702. Alternately, a flat-bottomed test tube 703 can be used, however, the flat-bottomed test tube 703 may have difficulty being secured via a vacuum unless an angled edge is used as a guide to align it with o-ring 704. In an embodiment, the diameter of the flat-bottomed test tube 703 can match the o-ring 704 diameter, and the base 705 can be smooth. While the test tubes depicted can have curved or flat bottoms, conical test tubes and test tubes with non-traditional geometries are additionally contemplated. Moreover, the test tube vacuum retainer system can be designed to work with test tubes made from materials including, but not limited to, glass, plastic, and composites thereof.

Figure 8B:
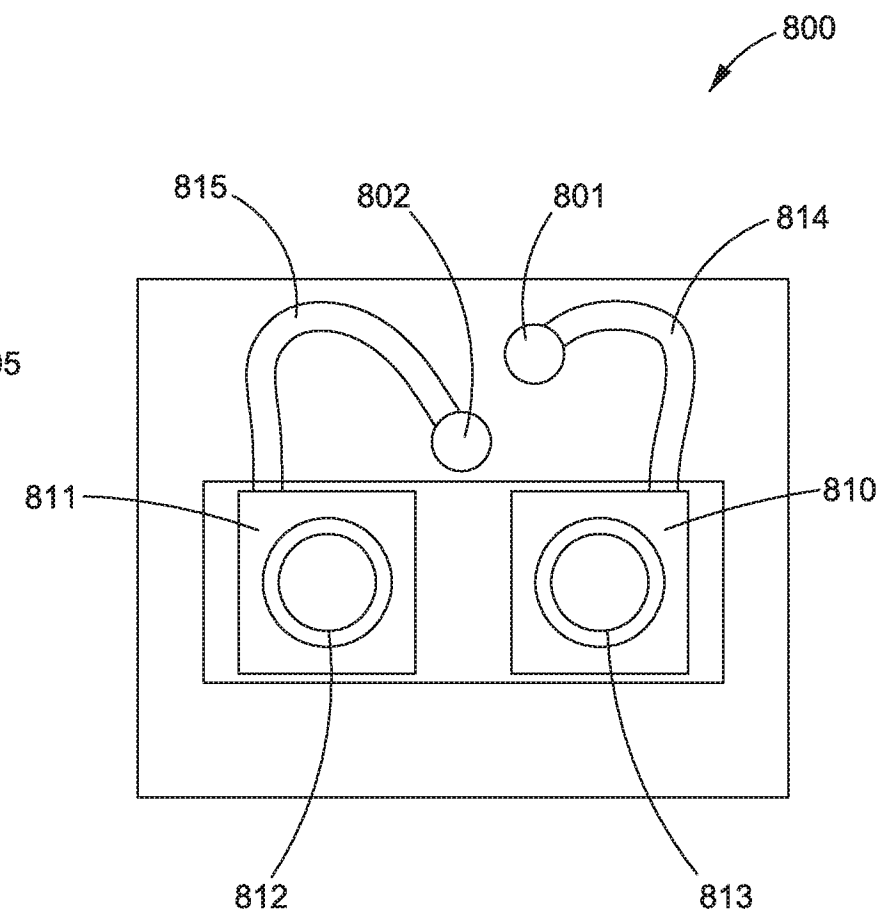
FIGS. 8A-8C illustrate a multi-test tube vacuum retainer system, in accordance with embodiments described herein.
Figure 8A:
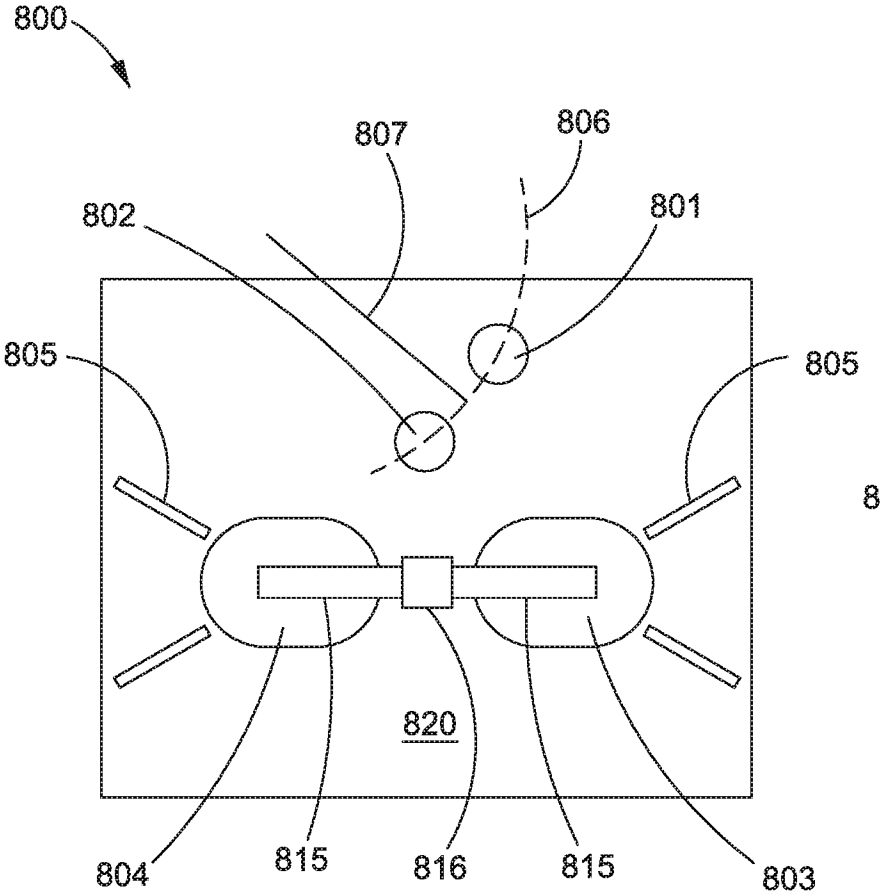
Figure 8C:
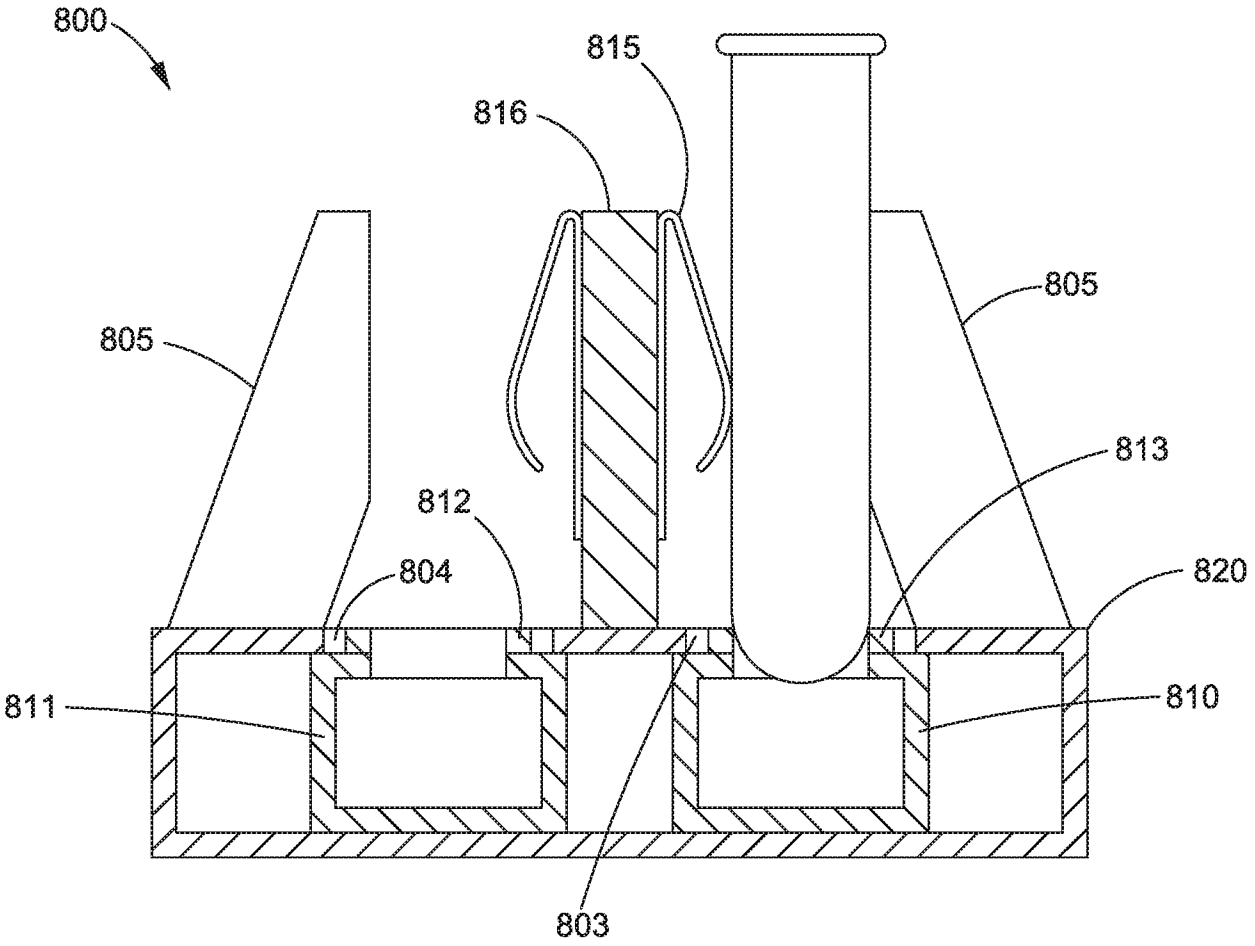

FIGS. 8A-8C illustrate a multi-test tube vacuum retainer system, in accordance with embodiments described herein. The multi-test tube vacuum retainer system 800 can have a first access hole 803 and a second access hole 804, each of which can be slotted in shape to allow and constrain lateral motion of the test tubes and to enable the multi-test tube vacuum retainer system 800 to be able to accept test tubes of varying diameter. The holes 803, 804 can be bounded by support fins 805. Springs 815 held by a central post 816 can press the test tubes horizontally against the support fins 805 to securely position the test tubes horizontally and force the test tubes to maintain a vertical orientation with respect to the top plate 820. A first vacuum outlet 801 and a second vacuum outlet 802 can be used to supply a vacuum force to the first access hole 803 and the second access hole 804, respectively. The first and second vacuum outlets 801, 802 can be aligned along an arc 806, which can correspond to the path of a robotic arm 807 used in a larger assembly to apply the vacuum pressure.

As shown in the cutaway view of FIG. 8B, the first access hole 803 (not shown in FIG. 8B) can have a first receptacle 813 mounted atop a first base 810, while the second access hole 804 (not shown in FIG. 8B) can have a second receptacle 812 mounted atop a second base 811. A first tube 814 can connect the first vacuum outlet 801 to the first base 810, while a second tube 815 can connect the second vacuum outlet 802 to the second base 811. Each of the vacuum systems in the multi-test tube vacuum retainer system can function in substantially the same manner as in the single test tube vacuum retainer system model.

In an embodiment, a place sequence using the multi-test tube vacuum retainer system can involve moving the vacuum robot arm 807 to the first vacuum outlet 801 while a gripper holding a test tube moves to the first access hole 803. The gripper can place the test tube into the first access hole 803, release the test tube, and then the vacuum robot arm 807 can apply a vacuum to the first vacuum outlet 801, securing the test tube in place in the first access hole 803. The test tube vacuum retainer system can monitor the pressure to verify the seal while applying a vacuum. The system can perform similar steps for the second vacuum system. A pick sequence can involve moving the vacuum robot arm 807 to the first vacuum outlet 801 while a gripper moves to the first access hole 803. The vacuum robot arm 807 can release the vacuum in the first vacuum outlet 801, while the gripper grips the test tube and removes the test tube from the first access hole 803. The test tube vacuum retainer system can monitor the pressure to verify the seal, at which point it can release the vacuum. The vacuum robot arm 807 can then move away from the first vacuum outlet 801.

While various aspects and embodiments have been disclosed herein, other aspects and embodiments will be apparent to those skilled in the art. The various aspects and embodiments disclosed herein are for purposes of illustration and are not intended to be limiting, with the true scope and spirit being indicated by the following claims.

The functions and process steps herein may be performed automatically or wholly or partially in response to user command. An activity (including a step) performed automatically is performed in response to one or more executable instructions or device operation without user direct initiation of the activity.

The system and processes of the figures are not exclusive. Other systems, processes, and menus may be derived in accordance with the principles of the invention to accomplish the same objectives. Although this invention has been described with reference to particular embodiments, it is to be understood that the embodiments and variations shown and described herein are for illustration purposes only. Modifications to the current design may be implemented by those skilled in the art, without departing from the scope of the invention. As described herein, the various systems, subsystems, agents, managers, and processes can be implemented using hardware components, software components, and/or combinations thereof. No claim element herein is to be construed under the provisions of 35 U.S.C. 112, sixth paragraph, unless the element is expressly recited using the phrase "means for."

I claim:

1. A test tube vacuum retainer system, comprising:

an outer body comprising one or more side walls, a bottom wall, a top plate comprising an access hole, and a midline plate between and substantially parallel to the bottom wall and the top plate;

a base;

a test tube holder having an inner area comprising a sealant ring within the inner area, wherein the sealant ring comprises a resilient material and forms an access port aperture therethrough, wherein the test tube holder is attached to a top surface of the base, wherein the test tube holder is secured within the outer body to the base, which in turn is secured to the midline plate;

a vacuum tube comprising an external outlet; and a retainer plate forms therethrough a circular area aperture and an access area aperture from the circular area apertures to an edge of the retainer plate, wherein the retainer plate is configured to further secure the test tube holder by placing the test tube holder within the circular area aperture and the vacuum tube within the access area aperture, and wherein the retainer plate attaches to the outer body at a location above the base and below the top plate;

wherein the vacuum tube is connected to the test tube holder at a first end, and the external outlet is configured to be connected to a vacuum pump configured to apply a vacuum force to at the access port aperture when a test tube is placed onto the test tube holder such that the test tube can be pulled inwardly toward the base by the vacuum force and a seal can form between a surface of the sealant ring and a surface of the test tube, and wherein a vacuum chamber can be formed by the test tube, the sealant ring the test tube holder, and the base.

2. The test tube vacuum retainer system as recited in claim 1, wherein the access hole has a larger diameter than a diameter of the sealant ring.

3. The test tube vacuum retainer system as recited in claim 1, wherein the sealant ring comprises an o-ring.

4. The test tube vacuum retainer system as recited in claim 1, wherein the sealant ring comprises a spherical seal.

5. The test tube vacuum retainer system as recited in claim 1, wherein the sealant ring comprises a conical seal.

6. The test tube vacuum retainer system as recited in claim 1, wherein the vacuum pump is housed externally outside the outer body.

7. A multi-test tube vacuum retainer system, comprising:

an outer body comprising one or more side walls, a bottom wall, and a top plate comprising a first access hole, a second access hole, a first vacuum outlet, a second vacuum outlet, and a midline plate between and substantially parallel to the bottom wall and the top plate;

a first receptacle located under the first access hole comprising a first vacuum chamber forming a first aperture therethrough, wherein the vacuum chambers comprise a first sealant ring within the first aperture, wherein the first sealant ring comprises a resilient material and forms an access port aperture therethrough;

a second receptacle located under the second access hole comprising a second vacuum chamber forming a second aperture therethrough, wherein the second vacuum chamber comprises a second sealant ring within the second aperture, wherein the second sealant ring comprises the resilient material and forms a second access port aperture therethrough;

a first vacuum tube connecting the first vacuum outlet to the first receptacle;

a second vacuum tube connecting the second vacuum outlet to the second receptacle; and a vacuum robot arm connected to a vacuum pump;

wherein the vacuum pump is configured to apply a vacuum force to the first receptacle through the first vacuum outlet when a first test tube is inserted into the first access hole and placed onto the first sealant ring such that the first test tube can be pulled inwardly into the first receptacle by the vacuum force and a first seal can form between a first surface of the first sealant ring and a first surface of the first test tube or the second receptacle through the second vacuum outlet when a second test tube is inserted into the second access hole and placed onto the second sealant ring such that the second test tube can be pulled inwardly into the second receptacle by the vacuum force and a second seal can form between a second surface of the second sealant ring and a second surface of the second test tube when a vacuum is applied by the vacuum robot arm.

8. The multi-test tube vacuum retainer system as recited in claim 7, wherein the first vacuum outlet and the second vacuum outlet are positioned on an arc.

9. The multi-test tube vacuum retainer system as recited in claim 7, wherein the top plate further comprises a flexible material with one or more support fins configured to horizontally constrain a test tube when inserted into the first receptacle or the second receptacle.

10. The multi-test tube vacuum retainer system as recited in claim 9, further comprising one or more springs held by a center post, each configured to press a test tube against the support fins.

11. The multi-test tube vacuum retainer system as recited in claim 7, wherein the first access hole has a larger diameter than the first sealant ring.

12. The multi-test tube vacuum retainer system as recited in claim 7, wherein the first sealant ring comprises an o-ring.

13. The multi-test tube vacuum retainer system as recited in claim 7, wherein the first sealant ring comprises spherical seals.

14. The multi-test tube vacuum retainer system as recited in claim 7, wherein the first sealant ring comprises conical seals.

15. A test tube vacuum retainer system, comprising:

a tank having a top plate and a bottom plate, wherein the top plate forms a tank aperture therethrough;

a spring inside the tank and attached to the tank at the bottom plate;

a hollow stem, wherein a bottom portion of the hollow stem is within the tank and connected to the spring, wherein the hollow stem extends out of the tank through the tank aperture and a top portion of the hollow stem is outside of the tank; and a receptacle attached to the top portion of the hollow stem;

wherein a vacuum is applied to the tank via a vacuum hose connected to a vacuum pump, wherein the vacuum hose is in fluid communication with an internal volume of the tank;

wherein the hollow stem comprises a side wall, wherein the side wall forms an hollow stem aperture therethrough, wherein the hollow stem apertures is sized and positioned such that when a test tube is inserted into the receptacle and a downward force is applied, the hollow stem aperture, through depression of the spring, lowers into the tank and the vacuum is transferred within the hollow stem to secure the test tube to the receptacle.

16. The test tube vacuum retainer system as recited in claim 15, further comprising:

a power source configured to supply power to the vacuum pump.

17. The test tube vacuum retainer system as recited in claim 15, wherein the receptacle further comprises an o-ring.

18. The test tube vacuum retainer system as recited in claim 15, wherein the receptacle further comprises a spherical seal.

19. The test tube vacuum retainer system as recited in claim 15, wherein the receptacle further comprises a conical seal.

* * * * *